United States Patent [19]

Lovqvist

[11] Patent Number: 4,458,623

[45] Date of Patent: Jul. 10, 1984

[54] BOAT HULL

[75] Inventor: Bengt A. E. Lovqvist, Vetlanda, Sweden

[73] Assignee: Skandinaviska Aluminium Profiler A.B., Vetlanda, Sweden

[21] Appl. No.: 376,196

[22] Filed: May 7, 1982

[51] Int. Cl.[3] ..... B63B 7/04

[52] U.S. Cl. ..... 114/352

[58] Field of Search ..... 114/77 R, 77 A, 86, 114/88, 355–358, 65 R, 352; 52/396, 536, 595

[56] References Cited

U.S. PATENT DOCUMENTS

| | | | |
|---|---|---|---|
| 3,093,847 | 6/1963 | Strecker | 114/357 |
| 3,246,349 | 4/1966 | Lyon | 114/358 |
| 3,811,141 | 5/1974 | Stoeberl | 114/357 |

FOREIGN PATENT DOCUMENTS

| | | | |
|---|---|---|---|
| 2844259 | 4/1979 | Fed. Rep. of Germany | 114/356 |
| 113476 | 2/1918 | United Kingdom | 114/88 |

*Primary Examiner*—Trygve M. Blix
*Assistant Examiner*—Jesûs D. Sotelo
*Attorney, Agent, or Firm*—Spencer & Frank

[57] ABSTRACT

A boat hull is prepared from a plurality of elongate extrusions, for example of aluminum. Each extrusion has, at one edge, a projecting tongue and at the other edge a groove. The projecting tongue may be inserted into the groove and may be snap-fastened into position. The tongue and the groove are dimensioned to define a clearance therebetween, and the clearance is filled with an adhesive so that the extruded sections are tightly joined with each other.

13 Claims, 7 Drawing Figures

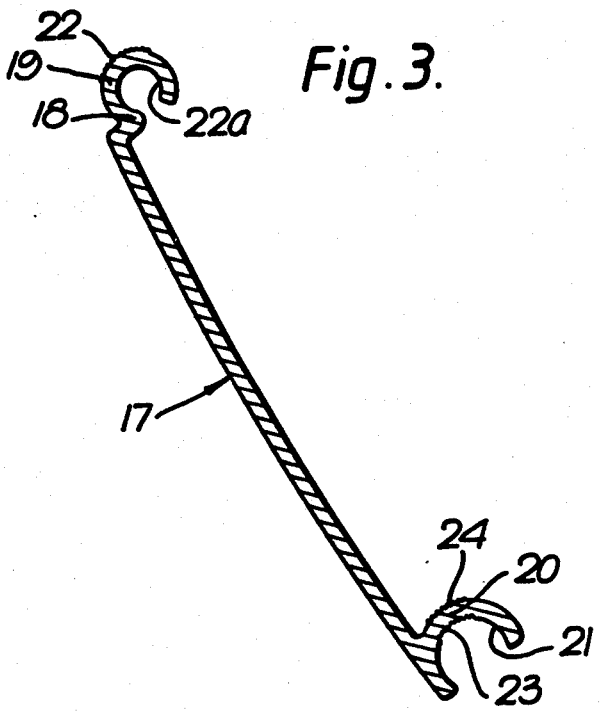
Fig. 3.
Fig. 4.
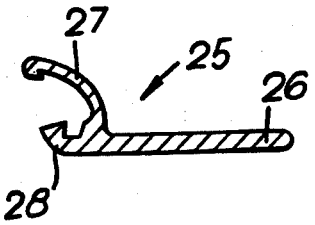
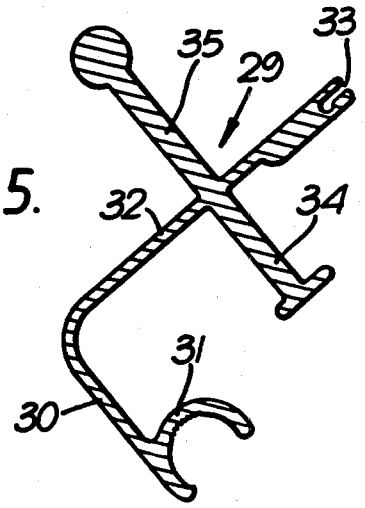
Fig. 5.

Fig.6.
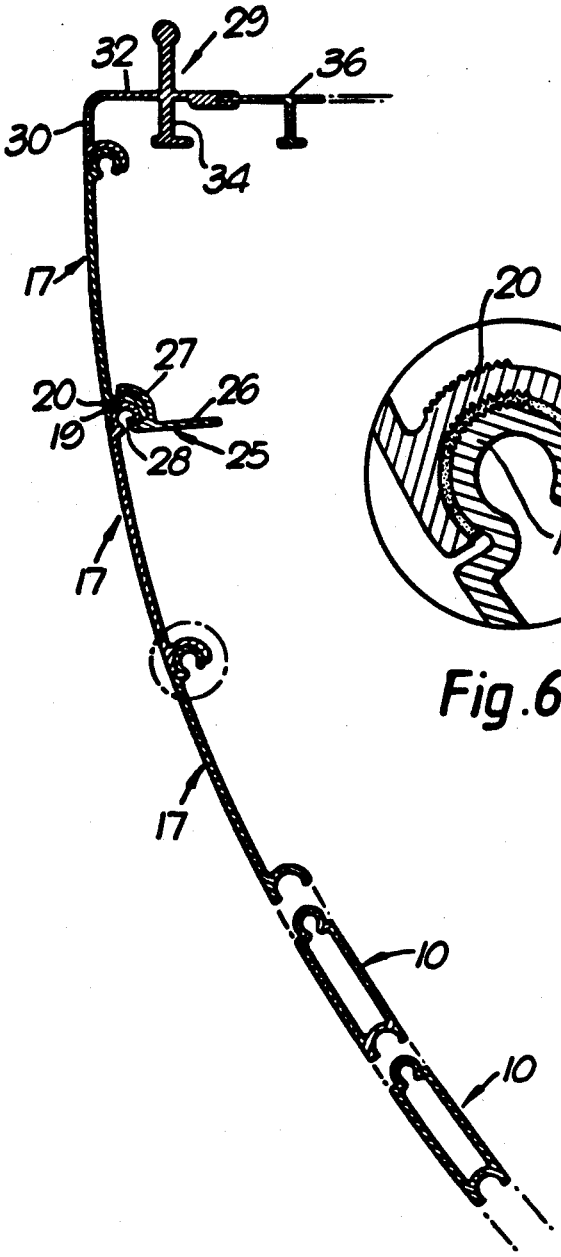
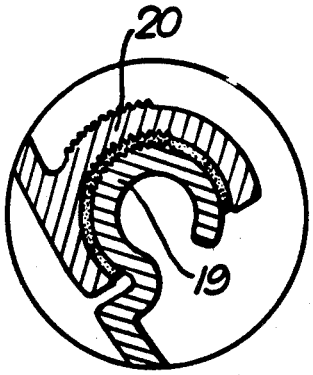
Fig.6a

BOAT HULL

BACKGROUND TO THE INVENTION

The present invention relates to a boat hull and more particularly to a boat hull fabricated from a large number of long plank elements. The boat hull may be utilised in the manufacture of a boat, particularly a leisure or recreation boat, such as a dinghy, a sailing boat, or even an ocean-going yacht.

At the present time most leisure or recreation boats are made of glass fibre reinforced plastics material, since this material can be worked easily and this material is also corrosion resistant. However, the use of a plastics material for a boat hull has certain drawbacks, since the material is combustible, and also the material may give off a bad smell. Also, the manufacture of the boat hulls from reinforced plastics material is associated with several disadvantages and risks with regard to the working environment, since the materials utilised emit impurities which are detrimental to health during the fabrication of the hulls.

In view of the above mentioned drawbacks and disadvantages other materials have been utilised in manufacturing boat hulls, such as steel and aluminum. These materials are particularly advantageous since they are non-combustible, and thus the use of such materials provides some degree of safety in case of a fire on board. However, the use of such materials is associated with the disadvantage that the hulls are difficult to fabricate in manufacture, since the hulls must be formed from separate hull elements which are welded together. As is well known, welding is an operation that involves high manufacturing costs, especially with a low production run.

In view of the high prices of leisure and reaction boats manufactured as described above, it has been proposed for such boats to be fabricated by handymen or hobbyists, and thus there has been some demand for construction kits. By providing such construction kits it has been possible for handymen and hobbyists to produce boats made of a plastics material at an economic price, but the potential health hazard to the handymen or hobbyist has been considerable. Up to now it has not been practicable for the handymen or hobbyist to produce a home-made boat from steel or aluminum with the aid of a construction kit.

Aluminum is a material that has been found to be particularly suitable for use in fabricating boat hulls, since it has a high corrosion resistance in marine use, and it also has a low weight when compared with steel. Also aluminum is a material that can be worked with easily. However, up to now it has not been possible to produce boat hulls with double-curved hull sides of aluminum at a competitive price, especially with a low production run.

OBJECT OF THE INVENTION

The main object of this invention is to provide a boat hull that can be easily fabricated from aluminum, the hull sides having a double-curved shape, if desirable, so that the design of the hull can substantially correspond with the design of conventional hulls made from wood or plastics material.

It is another object of the invention to provide a kit of parts from which a boat hull can readily be fabricated.

BRIEF SUMMARY OF THE INVENTION

According to this invention there is provided a boat hull, said boat hull comprising a plurality of elongate plank elements, each comprising an extruded section having two opposed edges, therebeing a projecting tongue extending along the full length of the extruded section at one said side edge, and therebeing a groove extending continuously along the full length of the extruded section at the other side edge, said projecting tongue being dimensioned to be inserted into a groove of a corresponding adjacent extruded section, the said groove being designed to receive a projecting tongue inserted thereinto whilst leaving a clearance between a tongue and the groove, said clearance between the tongue and the groove being filled with an adhesive, so that the extruded sections are tightly joined with each other.

Since the plank elements of the boat hull consist of extruded sections, having the edges thereof designed so that the sections can be connected together with a clearance between the joining or interlocking portions, the sections can be twisted around their longitudinal axes, so that two adjacent sections can have different angles of inclination relative to each other at different points spaced along the length of the sections, and the sections can still be satisfactorily connected to each other by the aid of the adhesive inserted between the interlocking portions of the interconnected sections. Thus the plank elements can have a double-curved shape and thus the sides of the hull will obtain the desired configuration. By utilising flexible and twistable extruded sections each having a projecting tongue along one edge and a corresponding groove along the opposite edge, the extruded sections can easily be connected together, especially if the walls of the tongue, and/or the groove are flexible. The adhesive provided in the clearance between the walls of the tongue and the groove will provide an impermeable or leak proof joint. Thus a very simple method of assembling the plank elements can be adopted when building the hull, providing considerable advantages in the industrial manufacture of hulls, and in the private manufacture of hulls by handymen or hobbyist.

BRIEF DESCRIPTION OF THE DRAWINGS

FIG. 3 is a cross-sectional view of yet another extruded plan element for use in the construction of a boat hull in accordance with the invention, FIG. 4 is a cross-sectional view of an extruded linking member which can be utilised when interconnecting a plurality of extruded plank elements as shown in FIG. 3, FIG. 5 is a cross-sectional view of an extruded gun whale section for use in forming a boat hull in accordance with the invention, and FIG. 6 is a vertical cross-sectional view through part of a boat hull in accordance with the invention showing extruded sections of the type shown in FIGS. 1 and 3 to 5 interconnected together.

FIG. 6*a is a cross-sectional detail view, to a larger scale, of the portion of FIG. 6 which is enclosed by a broken-circle.*

DETAILED DESCRIPTION OF PREFERRED EMBODIMENTS

Figure 1:
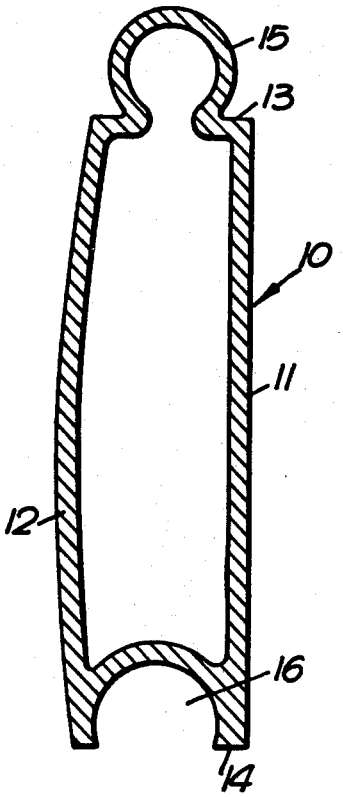
FIG. 1 is a cross-sectional view of an extruded plank element used in the construction of a boat hull in accordance with the invention.

FIG. 1 illustrates an extruded plank element 10 that, as will be described hereinafter, can be ustilised in constructing a boat hull in accordacne with the invention. The extruded plank element is shown in a vertical orientation and has two side faces, 11 and 12, and also has a top edge 13 and a bottom edge 14. Thus the plank element 10 is double-walled. One side, 11, of the plank element is planar, and is intended to form the interior of the hull of a boat. However, the other side 12 of the plank element 10 is curved and is intended to form the exterior of the hull of the boat. The upper edge 13 of the extruded plank element is provided with a tongue 15 which is of substantially part-circular cross section. Thus the tongue 15 has a portion of greater diameter which is connected to the rest of the plank element 10 by a neck of lesser diameter. The lower edge of the extruded plank element is also formed to define groove 16 which also has a substantially part-circular cross-section, this cross-section being greater than a semi-circle. Thus the groove can be considered as being defined by two opposed arms that have inwardly directed free ends.

The groove 16 has a larger diameter than that of the tongue 15 and the arrangement is such that the tongue 15 of one extruded plank element can be "snapped" into the groove 16 of another corresponding plank element, so that the tongue 15 is retained within the groove. The relative sizes of the tongue 15 and the groove 16 are such that a space axis between the tongue and the groove when the tongue has been introduced into the groove.

The extruded element 10 is, as can be seen in FIG. 1, hollow and may for example be extruded from aluminum. Aluminum extrusions of arbitrary lengths, for example 10 or 20 meters, may be fabricated and these may be cut to the desired length when necessary. In a typical extruded plank element as illustrated in FIG. 1 the sides 11, 12 may be approximately 50 millimeters high, and the edges 13 and 14 may be approximately 10 millimeters wide. The wall thickness of the extrusion may be approximately 2 millimeters.

Such an extruded section can easily be bent both in a horizontal plane and in a vertical plane when the plank element is in the orientation illustrated in FIG. 1. Also the extruded plank element may be twisted to a certain extend about its longitudinal axis.

Since there is no transverse web extending across the extrusion at the lower edge of the tongue 15 a certain degree of flexibility is provided so that the tongue, and the immediately associated portions of the side walls 11 and 12, may be compressed together to some extent in order to facilitate the insertion of the tongue 15 into a corresponding groove 16. In the embodiment presently being described the walls defining the groove 16 have no flexibility, or only insignificant flexibility.

The groove 16 and the tongue 15 both have a diameter of approximately 10 millimeters, but the diameter of the groove 16 is somewhat larger than the diameter of the tongue 15 so that when the tongue 15 is inserted into the groove 16 a clearance of the order of 0.1 millimeter is provided between the tongue and the grooved but the groove may be wider or narrower than this, depending on the precise nature of the adhesive utilised. Due to the existence of this clearance, and due to the possibilty of twisting the extruded plank elements around their longitudinal axes, the extruded plank elements can take different angular positions in relation to each other at different points along the lengths thereof. This enables a number of plank elements to be utilised to form a hull with a double-curved or complex-curved shape. Thus the shape of the resultant hull will agree substantially with the hull of a conventional boat formed from a plastics material or formed from wood.

It is to be understood that the tongue 15 and the groove 16 both extend continuously along the full length of the extruded element, and, in a typical case, when the tongue 15 has been inserted into a groove 16 the resulant clearance between the tongue and the wall of the associated groove is filled with a sealing substance in the form of an adhesive, so that the separate extruded sections are firmly connected to each other, and so that a weather proof and waterproof sealing is provided between the interconnected extruded plank elements. Thus in this typical case the interconnected elements thus do not touch each other, but are interconnected by the adhesive. However, it is possible that in certain circumstances there may be point contact between the interconnected elements.

Due to the fact that the extruded plank elements are interconnected by means of an adhesive a boat hull can be fabricated from plank elements as described above without the use of frame ribs. The extruded plank elements give a sufficient stability to a boat hull manufactured from such plank elements due to the design of the plank elements and their inherent strength. Nevertheless, for several reasons it may be desired to provide frame ribs within a boat hull fabricated from plank elements as described above, for example in order to facilitate the installation of equipment in the boat, and also to facilitate the installation of steering means, for example, and control equipment for a motor.

It is to be understood that in a boat hull in accordance with the invention any frame ribs that are provided can be disigned to be weaker than the frame ribs utilised in a corresponding conventional boat, since the frame ribs do not need to be able to keep the sides of the boat hull apart, but only need to be able to support any fittings and equipment mounted on the frame ribs.

In certain embodiments not all the extruded plank elements need be connected by means of an adhesive, since some of the extruded plank elements can be connected by means of frame ribs. However at least some plank elements of a hull in accordance with the invention must be connected by the use of adhesive. Where adhesive is not utilised the plank elements must be mounted on appropriate frame ribs, although these frame ribs may be designed to be weaker than the corresponding ribs in conventional boats, since the frame ribs only have to take up forces tending to separate the extruded plank elements, i.e. forces acting in the longitudinal direction of the frame ribs. Thus, in a boat hull in accordance with the invention the different portions of the frame ribs are exposed only to traction.

When an adhesive is utilised in connection with the plank elements described above, it is to be appreciated that the adhesive must be able to withstand the environment in which the boat is to be used. Thus if the boat is a marine boat for use in the sea an appropriate adhesive must be used. It has been found that epoxy adhesive, or polyurethane adhesives, or silicone adhesive may prove to be suitable.

Since the plank elements are extruded, the plank elements are of uniform cross section along their entire length, and thus have a constant width and a constant height. It is to be appreciated that extruded plank elements of the same cross-section can be utilised for manufacturing boat hulls of various different sizes and designs. This is an important advantage, since it is not necessary to extrude specially designed plank elements when manufacturing only a few hulls of one particular size and design. Instead a large stock of extruded plank elements can be manufactured at one time, and then the extruded plank elements can be cut to length and utilised in the manufacture of boat hulls of various sizes and designs.

Figure 2:
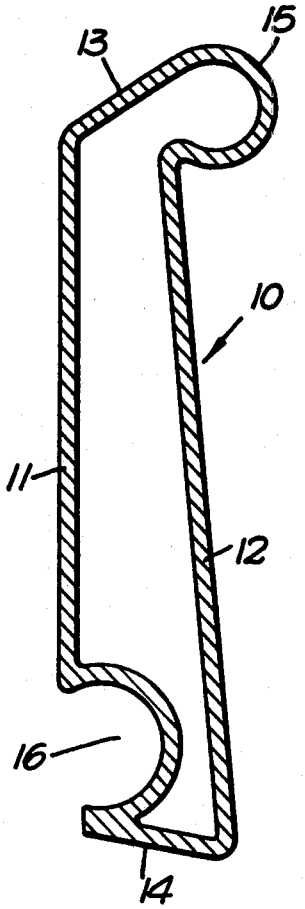
FIG. 2 is a cross sectional view of another form of extruded plank element intended for use in the construction of a boat hull in accordance with the invention.

The extruded plank elements shown in FIG. 1 are intended primarily for use when manufacturing carvel-built boat hulls, that is to say boat hulls in which adjacent plank elements are substantially flush. It is to be appreciated, however, that a boat hull in accordance with the present invention may be clinker-built, with the interconnected plank elements overlapping. FIG. 2 shows an extruded double-walled plank element, generally corresponding to the plank element shown in FIG. 1, but specifically designed for use when manufacturing a clinker-built boat hull, In FIG. 2 the same reference numerals have been utilised as in FIG. 1 for the corresponding portions of the plank element, and thus it is not necessary to provide a specific detailed description of the plank element of FIG. 2.

FIG. 3 is a cross-sectional view of a single-walled extruded plank element 17 which has an upper flange 18 of curved configuration which forms a tongue 19 extending along the top edge of the plank element 17. The extrusion also has a second curved flange 20 which serves to define a groove 21 along the lower edge of the plank element 17. The tongue 19 and the groove 21 have the same function as described in connection with the plank element shown in FIG. 1. However the outer surface of the flange 18 defining the tongue 19 is provided with a plurality of parallel longitudinal ribs 22, and a similar set of parallel longitudinal ribs 23 is provided on the inner surface of the flange 20 defining the groove 21. The ribs 22 and 23 are provided to ensure that there is an adequate key between the extruded plank element and the adhesive that is provided between the tongue 19 of one element and the groove 21 of the next adjacent element connected thereto. The outer surface of the curved flange 20 is also provided with parallel below.

FIG. 4 is a cross-sectional view of a linking member 25 that is illustrated, by way of example, as being utilised to interconnect the extruded sections of the type shown in FIG. 3. The linking member comprises a main portion 26 with two extensions 27, 28 at one end thereof. One extension 27 is hook-shaped and designed to engage with any of the ribs 24 on the outer surface of the grooved flange 20 shown in FIG. 3. The other extension 28 is angularly directed towards the free end of the hook-shaped extension 27 and is intended to engage with the groove **22*a* which is defined by the interior of the flange 18 which defines the tongue 19. When the extensions have been engaged with the groove 22*a* of one plank element 17 and the ribs 24 provided on another plank element 17 connected thereto, the linking member 25 serves to hold the two extruded sections tightly together. Thus the linking member will compress any adhesive between the tongue and the groove. This is often desirable to aid setting of the adhesive. This is illustrated in FIG. 6. The main portion 26 of the linking member 25** is intended to be attached to a rib frame, if the rib frames are provided, or can serve as a support for fittings or equipment to be mounted in the hull.

The linking member can be used to hold the extruded sections together while the adhesive sets, and may then, if desired, be removed. Alternatively the linking members can be left in position and the main portion of the linking member can then, for example, be welded to a rib or some other fitting. This is preferable to welding anything directly to one of the extruded sectors since if anything is welded directly to one of the extruded sectors that is under tension (e.g. that is in a curved condition) the portion of the extruded member adjacent the weld will anneal, and the annealed portion will deform, so that the member will no longer be uniformly curved, but will then have a relatively sharp corner adjacent the weld.

Linking members similar to those described may be used with the double walled extrusions, if additional engagement ribs are provided on such extrusions or if holes are cut in the extrusions to provide access to the interiors thereof.

FIG. 5 is a cross-sectional view of an extruded gunwhale section 29 and is intended to be used as a connection between the upper most plank element of a hull in accordance with the invention and the gunwhale, as indicated in FIG. 6. The gunwhale section 29, is of substantially cruciform construction, one arm 32 of the extrusion 30 being provided with a flange 31 defining a groove of the type described above with reference to the FIG. 3, this groove being dimensioned to engage with the tongue of the uppermost plank element of a hull in accordance with the invention as described above. A second arm 34 of the cruciform section 29 acts as a reinforcing element, and a third arm carries a terminal groove 33 defined to receive the edge of a gunwhale section 36, for example of the type shown in FIG. 6. The fourth arm of the cruciform connector comprises a gunwhale-moulding 35, this being on the upper side of the connector, when the connnector is in position.

FIG. 6 illustrates schematically the assembly of a number of different extruded sections as described above to constitute a boat hull in accordance with the invention. Plank elements 10 of the type shown in FIG. 1 are used to form the bottom of the hull, and these elements may be connected to a keel if a keel is provided. The double-walled plank element used in the bottom of the boat hull are connected to single-walled plank elements 17 of the type shown in FIG. 3 constituting the upper planking of the boat hull. The plank elements 10 are subtantially narrower than the plank elements 17. The uppermost plank element 17 is connected to the gunwhale 36 by means of the gun whale section 29 shown in FIG. 5.

In the arrangement shown in FIG. 6 the double-wall plank elements 10 are connected to the single-walled plank elements 17 by means of frame ribs (not shown) and the single-walled plank elements are connected to each other by means of linking members 25 of the type shown in FIG. 4. However, linking members 25 may also be used with the double-wall plank elements, as has been described above. The extruded sections 10, 17, 29 and 36 are also all connected to each other by the adhesive substance applied between the walls of the interconnected tongues and grooves, all the tongues and grooves being dimensioned to ensure that there is a clearance between each interconnected tongue and groove which can be filled with the adhesive. This is shown in detail in FIG. 6*a* for the connection between the tongue 19 of one single-walled plank element and flange 20 of an adjacent single-walled plank element. This provides the advantage that pressure can be applied to the interlocking portions while the adhesive cures, and when the adhesive has thus cured the two interconnected plank elements are held in their desired relative positions and also a waterproof and weather-tight seal is formed between the two interconnected plank elements.

It is particularly convenient to combine double walled and single walled extruded plank elements as shown in FIG. 6, but it is to be appreciated that a hull in accordance with the invention may be built utilising only double walled plank elements, or utilising only single walled plank elements.

The use of double-walled plank elements is preferable from the point of view of safety, since if each double-walled plank element is sealed at each end, the plank elements will each, themselves, have a positive bouyancy, and thus a boat hull fabricated from such plank elements will be virtually unsinkable. As an additional precaution the double-walled plank elements can be filled with a non-porous material, for example closed cell polyurethane foam. This provided sound insulation and thermal insulation and provides good protection against condensation within the hull. Also, of course, even if a plank element of this type is ruptured, the plank element will not lose its inherent buoyancy.

It is to be understood that since the plank elements are extruded it is very easy to design the plank elements to have longitudinal grooves formed therein, the longitudinal grooves being open towards the interior of the hull. If such grooves are provided they can be utilised to accommodate electrical wires and fuel feed lines or the like, and thus the wires and feed lines can be accommodated in a safe and aesthetically pleasing way. It is to be appreciated that the slots between adjacent plank elements on the exterior of the hull can be filled, in a conventional way, to give the boat hull a smooth appearance.

It is to be appreciated that many variations and modifications of the extruded sections described above are possible without departing from the spirit and scope of the present invention. For example, the various interengaging portions of the extruded plank elements can have another design, and the extruded plank elements can have, for example, one planar side, when single walled and two planar, or two curved sides when double walled. The extruded sections, if double-walled, can also be provided with one or more pockets for accommodating screws or the like for attaching the extruded sections to frame ribs, bulkheads or the keel. The sizes of the extruded plank elements can be selected within wide limits, and in certain cases a single "plank" for use in constructing a hull may be assembled from several joined extruded plank elements as described above, instead of, utilising one single extruded section, if this this will facilitate the assembly of the hull, or is desirable for any other reason, for example when manufacturing a boat hull of a large size All the above described extruded elements may be fabricated from aluminum, or may be made from an aluminum alloy or from a plastics material. The extruded plank elements can be finished in any conventional way, for example by anodising or painting.

It is to be understood that the extruded plank elements of the type described above may be utilised in the commercial manufacture of boat hulls, but may also be utilised by the handyman or hobbyist in the fabrication of individual hulls. Thus it is envisaged that kits of parts may be prepared, utilising plank elements as described above, the kits of parts being sold in a dis-assembled state, the purchaser of the kit then assembling the kit of parts at home to form a complete hull.

I claim:

1. A boat hull, said boat hull comprising: a plurality of elongate plank elements, each comprising an extruded section having two opposed edges, there being a projecting tongue extending along the full length of the extruded section at one said side edge, and there being a groove extending continuously along the full length of the extruded section at the other side edge, said projecting tongue being dimensioned to be inserted into a groove of a corresponding adjacent extruded section, the said groove being designed to receive a projecting tongue inserted thereinto while leaving a clearance between the inserted tongue and the groove, said clearance between the tongue and the groove being filled with an adhesive, so that the extruded sections are tightly joined with each other; and linking members provided at several positions along each joint between each pair of adjacent interconnected extruded sections, each said linking member comprising two portions designed to engage respectively with the tongue portion and groove portion of the interlocked plank elements, each linking member further comprising a main portion projecting from the said two portions and adapted to act as support for fixtures or fittings within the hull.

2. A boat hull according to claim 1 wherein the tongue and the groove are each of substantially part-circular cross section.

3. A boat hull according to claim 1 wherein the projecting tongue is designed to snap into the groove of the adjacent extruded section.

4. A boat hull according to claim 1 wherein the interconnected extruded sections provided with said linking members are single walled extruded sections.

5. A boat hull according to claim 1 wherein the outer side of the portion of the element defining the groove is provided with a plurality of projecting parallel ribs extending in the longitudinal direction of the extruded plank element and wherein one portion of the linking member is hook-shaped and is adapted to engage with one of said ribs and to cooperate with the other plank element to force the said tongue portion and the said groove portion together.

6. A boat hull according to claim 5 wherein the tongue portion serves to define an opened groove extending in the longitudinal direction of the extruded plank element, and said other portion of the linking member is designed to penetrate into said groove for engagement with said tongue portion.

7. A boat hull according to claim 1 wherein the inner side of the groove and the outer side of the tongue of two interconnected extruded sections are provided with parallel ribs extending in the longitudinal direction of the extruded section.

8. A boat hull according to claim 1 wherein said plank elements of the hull consist of single-walled extruded sections and constitute upper plank elements, and said boat hull further comprises lower plank elements consisting of double-walled extruded sections that are substantially narrower than said single-walled extruded sections.

9. A boat hull according to claim 1 wherein the upper most plank element is connected to a gunwhale by means of an angular extruded section having two portions, one of which is designed to be connected to the upper edge of the uppermost plank element, and the other in which is designed to be connected to the gunwhale.

10. A boat hull according to the claim 1 wherein the clearance between the tongue and the groove is about 0.1 millimeter.

11. A boat hull according to claim 1 wherein the clearance between the tongue and the groove is substantially filled with adhesive so that the tongue does not contact the groove at any point.

12. A boat hull according to claim 1 wherein the clearance between the tongue and the groove is substantially filled with adhesive and wherein there is direct contact between the tongue and the groove at at least one point.

13. A boat hull according to claim 1 wherein each extruded section consists of aluminum.

* * * * *